United States Patent [19]

Horng

[11] Patent Number: 4,704,914

[45] Date of Patent: Nov. 10, 1987

[54] CHAIN BREAKDOWN SAFETY DEVICE FOR A POWER-DRIVEN ROLLER DOOR

[76] Inventor: Jin-Shan Horng, No. 579-39, Aur Feng Road, Ching Shui Chen, Taichung Hsien, Taiwan

[21] Appl. No.: 839,968

[22] Filed: Mar. 17, 1986

[51] Int. Cl.[4] ..... F16H 57/10

[52] U.S. Cl. ..... 74/411.5; 49/322; 160/300

[58] Field of Search ..... 74/411.5; 474/148, 150, 474/273; 49/322, 199, 200; 160/291, 300, 311

[56] References Cited

U.S. PATENT DOCUMENTS 1,863,961 6/1932 Ball et al. ..... 49/322 X

FOREIGN PATENT DOCUMENTS 1659481 10/1969 Fed. Rep. of Germany ..... 160/291

*Primary Examiner*—Philip C. Kannan

*Attorney, Agent, or Firm*—Cushman, Darby & Cushman

[57] ABSTRACT

A chain breakdown safety device for a power driven roller door, having a movable elongate rod with a rack thereon driven by a spring control, an idler attached to the rod for engagement with the chain, the idler being structured in a manner such that it will withdraw its engagement with the chain once the chain breaks, to permit a spring to displace the movable rod, causing the rack thereon to turn a gear which is provided with a ratcheted pawl, which engages the chain sprocket on the roller door drive winch in order to stop the door from falling, thereby protecting bystanders or equipment from injury or damage resulting from the breaking of the chain.

3 Claims, 5 Drawing Figures

CHAIN BREAKDOWN SAFETY DEVICE FOR A POWER-DRIVEN ROLLER DOOR

SUMMARY OF THE INVENTION

The present invention provides a chain breakdown safety device for a power-driven roller door, such as a garage door, which can make prompt and timely stop of a downfalling roller door, in the event of a sudden break in the transmission chain. Such protection is provided through the activation of a ratchet wheel by a movable rod portion having a rack thereon when the incident takes place, thereby permitting safe operation of the door at all times.

The so-called power-driven roller doors are currently in use everywhere in the world and are widely adopted, yet cases do arise when such roller doors, on the point of suffering a breakdown of the transmission chain, as a result of long time of services, will collapse and slump down due to its own gravity. Owing to the absence of any safety devices which should have been provided to safeguard such horrible incidents, the tremendous force of destruction generated by falling roller doors has caused grievous injury and property damage to human beings, animals and valuables. Consequently, there has been a long and unfilled need in the art for a device to protect against such chain failure.

In short, the primary object of the present invention is to provide a chain breakdown safety device, which incorporates a spring-driven rod having a movable rack formed thereon, by the side of the chain compartment in the drive system of a roller door, which causes a ratcheted pawl to be engaged with one of the drive chain sprockets, thus preventing the chain wheel from running in the reverse direction.

A further object of the present invention lies in the provision of a chain breakdown safety device, wherein an idler provided on the movable rod is mounted for engagement with the chain, so as to bring the gear and ratchet pawl into operating position when the movable rack undergoes radial displacement, thereby holding the chain wheel still under the ratchet pawl control.

A further object of the present invention lies in the provision of a chain breakdown safety device, wherein the idlers for the movable rack are mounted outside the chain, one such idler kept to maintain in a position securely engaged with the chain, in order that its push-back pressure be discharged when the chain breaks open, so that the movable rod may transmit the ratchet pawl and the gears into operating position, so as to stop the chain wheel from further rotations.

Other features and advantages of the present invention will emerge from the following descriptions of embodiments given by way of illustration, but not in any way limiting, with reference to the accompanying drawings described.

DESCRIPTION OF DRAWINGS

Other objects, features, and characteristics of the present invention, as well as the methods and operation and functions of the related elements of the structure, and to the combination of parts and economies of manufacture, will become apparent upon consideration of the following description and the appended claims with reference to the accompanying drawings, all of which form a part of this specification, wherein like reference numerals designate corresponding parts in the various FIGURES.

DETAILED DESCRIPTION

Figure 1:
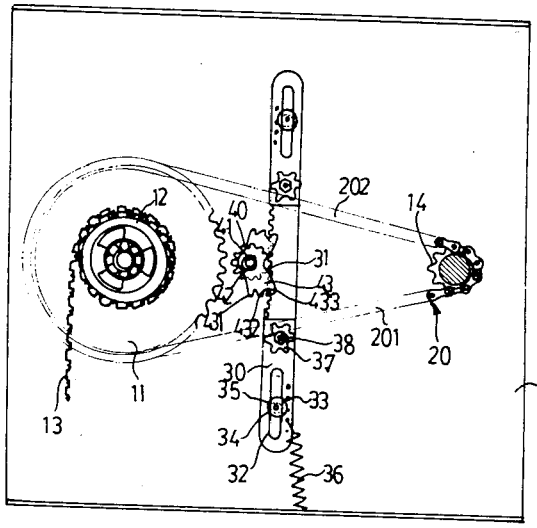
FIG. 1 the present invention seen in one embodiment under normal execution.

Referring to FIG. 1, it is seen that to facilitate uplifting operation of the door, winch 12 to roller door 13 by the transmission of the chain driven by the door rolling motor 3 installed on the board support 10. Motor 3 drives a sprocket 14, which in turn drives chain 20 to turn to a toothed chain wheel 11. Two conjugate steering rods 35 are provided, each symmetrical to the other between the two chain wheels, to permit engagement by long, ellipsoidal holes 32, provided on the oblong, movable rod 30. The steering rods 35 are each fastened to be positioned with a screwnut 34, to prevent offslipping. The middle section of the movable rod 30 is flattened on one side with a rack 31 provided thereon, to permit engagement with a gear 40 having a ratchet pawl 43. A wheel shaft 38 is provided projectingly near the chain 20, with an idler 37 mounted on the shaft 38 and mounted to ride on chain 20 by a screwnut 37. On one side of the long, ellipsoidal hole 32 are provided, in equal spaces, a number of hook holes 33, to facilitate the setting of modulation hooks as part of the spring 36. A gear 40 incorporating a winglike ratchet pawl 43 is mounted on a cam shaft 41 on the board support 10, then fastened with snap ring 42, to keep the gear 40 engaged to the rack 31 on the movable rod 30.

On the other hand, the hook holes 33 on either end of the movable rod 30 are configured symmetrically to each other, so as to accommodate optional hook-on laying of spring 36. The other end of spring 36 is attached in a spring hole near the edge of board support 10.

Accordingly, when the door rolling motor 3 transmits motion to chain wheel 11 through the pinion 14 and chain 20, the upper end of the chain 20 will, as a result of more exposure to stresses being applied thereto, have a tight part 202, whilst the lower end will be a relatively slack part 201. However, the spring 36 will always exert a certain tension, small it may be, with respect to the movable rod 35, thus compelling the idler 37 on the other side to abut closely against the chain 20.

Figure 2:
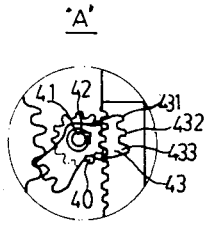
FIG. 2 is an illustration of the chain held under control when it breaks.

As will become apparent by reference FIGS. 1 and 2, the moment the chain 37 breaks, the idler 37 will effect radial pull from the tension applied by spring 36 in step with movable rod 30, whereupon the rack 31 will engage with gear 40, this setting the winglike ratchet pawl 43 on top into rotation, whereupon it engages the toothed portion of the chain wheel 11 arresting its motion. In spite of the recoil produced by the reacting chain wheel 12, the tangential component of the stress, passing the central position of both the first engaging tooth 431 and the cam shaft 41, will offset that force to yield a total instantaneous couple of zero, thereby stopping the wheel. Furthermore, should any momentum of force of rotation of the chain wheel 11 in the reverse direction be of such magnitude as to be sufficient to defeat or wear out the first engaging tooth 431, then the second engaging tooth 432 will come down almost instantaneously to further ensure that the motion of the chain wheel is arrested. In this way, it is obvious that the roller door 13 will stop where it is the moment the chain 20 breaks down.

Figure 3:
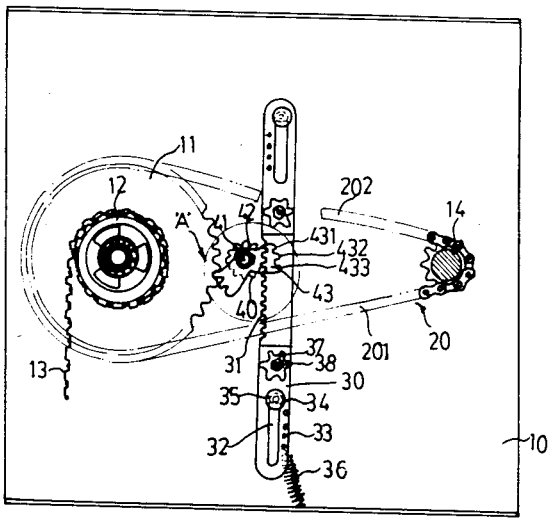
FIG. 3 is another illustration of the chain held under control when the chain breaks.
Figure 3:
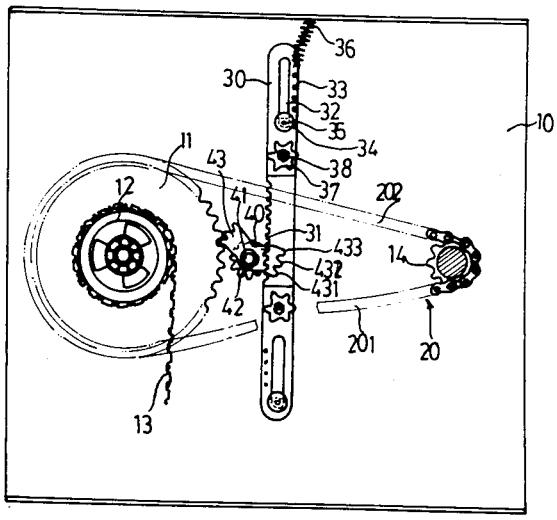
Figure 4:
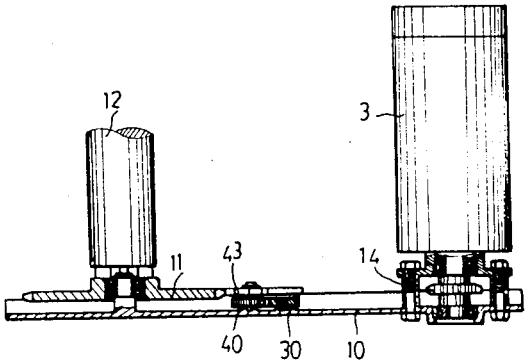
FIG. 4 is a bottom perspective of the invention.
Figure 5:
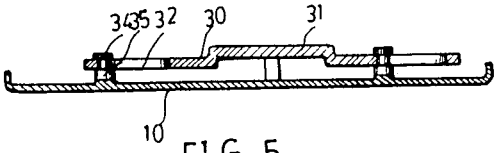
FIG. 5 is a perspective of the movable rack.

Referring to FIG. 3, another embodiment of the invention is illustrated wherein roller door 13 is assembled in the reverse order, yet the same advantageous performances remain. Replacements of the tight and slack parts can be done by changing the position of spring 36 to the end point of the movable rod 30 on the opposite side, and having the idler 37 underneath to get engaged with chain 20.

The device of the present invention, by the provision of a bilateral changeover facility, will prove equally useful for installment to either side of the roller door. In addition, the chain can easily be changed should it break; as described above. Most importantly, with the incorporation of the present device in a power-driven roller door system, the door will stop where it is in the wake of a breakdown, thereby preventing harm to persons or property therebeneath.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A safety device for a cable operated power driven roller door of the type having a motor, a sprocket attached to the motor, a chain mounted on the sprocket and a toothed chain wheel driven by the chain for winding or unwinding a cable to which the roller door is attached, comprising:

a steering rod disposed on both sides of said chain between said sprocket and chain wheel;

an elongate movable rod disposed substantially perpendicular to a line extending between the centers of said sprocket and said chain wheel, respectively, said movable rod having a pair of slots formed therein for receiving said steering rod and a toothed rack portion;

an idler roller mounted to said movable rod for engaging a portion of said chain;

means for biasing said movable rod means and said roller means against the chain; and ratcheting means for engaging with said toothed rack portion of said rod means for causing a first engaging tooth to engage said toothed chain wheel when said movable rod shifts, whereby said roller door will be prevented from falling should said chain fail.

2. A safety device for a cable operated power drive roller door according to claim 1, wherein said ratcheting means comprises a gear element and a first engaging tooth for engaging said chain wheel rotatably secured to said gear element.

3. A safety device for a cable operated power driven roller door according to claim 2 wherein said ratcheting means further comprises a second engaging tooth also rotatably secured to said gear element for engaging said chain wheel when said first engaging tooth has failed to arrest the motion of said chain wheel.

* * * * *